US006573642B1

(12) United States Patent
VonAllmen et al.

(10) Patent No.: US 6,573,642 B1
(45) Date of Patent: Jun. 3, 2003

(54) FIELD EMISSION DEVICE AND METHOD FOR THE CONDITIONING THEREOF

(75) Inventors: Paul VonAllmen, Mesa, AZ (US); Bernard F. Coll, Fountain Hills, AZ (US); Albert Alec Talin, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/491,357

(22) Filed: Jan. 26, 2000

(51) Int. Cl.[7] ..... H01J 1/304; H01J 19/24
(52) U.S. Cl. ..... 313/309; 313/496
(58) Field of Search ..... 313/361.1, 359.1, 313/336, 309, 351, 310, 495, 497

(56) References Cited

U.S. PATENT DOCUMENTS 2,809,314 A * 10/1957 Herb ..... 313/359.1
4,121,128 A * 10/1978 Roberts ..... 313/361.1
5,583,393 A * 12/1996 Jones ..... 313/495
5,942,206 A * 8/1999 Uhm et al. ..... 423/648.1
6,100,627 A * 8/2000 Carretti et al. ..... 313/309

* cited by examiner

*Primary Examiner*—Michael H. Day
(74) *Attorney, Agent, or Firm*—William E. Koch; Kevin D. Wills

(57) ABSTRACT

A field emission device (100) includes an electron emitter structure (105) having a deuteride layer (108), which defines a surface (109) of electron emitter structure (105). Deuteride layer (108) is disposed upon an electron emitter (106), which is made from a metal. Deuteride layer (108) is a deuteride of the metal from which electron emitter (106) is made.

A method for conditioning field emission device (100) includes the step of providing a contaminated cathode structure (137), which has a contaminated emitter structure (138). The method further includes the step of causing deuterium to react with a metal oxide layer (140) of emitter structure (138), so that the deuterium replaces the oxygen of metal oxide layer (140).

4 Claims, 1 Drawing Sheet

FIELD EMISSION DEVICE AND METHOD FOR THE CONDITIONING THEREOF

FIELD OF THE INVENTION

The present invention pertains to the area of field emission devices and, more particularly, to methods for cleaning and conditioning electron emitters in a field emission device.

BACKGROUND OF THE INVENTION

A typical field emission device contains electron emitters, such as Spindt tips, which are made from an electron-emissive metal, such as molybdenum. These electron emitters are susceptible to surface contamination by oxygen-containing, sulfur-containing, and carbon-containing species. The surface oxygen and carbon have deleterious effects on the electron emission properties of the electron emitters. In particular, the presence of oxygen and carbon at the emissive surface increases the surface work function of the electron emitters. That is, a larger electric field is required to extract electrons therefrom due to the contamination. Surface contaminants also result in emission current instability and reduced device lifetime.

Metal field emission tips have been employed in field emission electron and ion microscopy, scanning tunneling microscopy, etc. It is known to remove surface contaminants from electron emitters in these microscopy systems by employing high temperature (greater than 2000° K) flashing. However, field emission arrays often include glass substrates upon which the electron emitters are formed. These glass substrates have temperature tolerances up to 700–800° K. Thus, high temperature cleaning procedures cannot be used for decontaminating field emission electron emitters formed on glass substrates.

It is also known in the art that hydrogen treatment of the electron emitters improves the field emission and leads to higher current. It is believed that one of the main mechanisms of improvement is removal and replacement of surface oxygen by the hydrogen. Once in the surface, the hydrogen acts as a protective layer preventing further oxidation or other chemical contamination of the surface.

However, a problem with this prior art scheme is that field emitted current induces desorption of hydrogen from the surface of the electron emitter. Thus, during the operation of the device, the protective surface hydrogen layer is removed, causing deterioration of the performance and lifetime of the device.

Accordingly, there exists a need for an improved field emission device and method for the conditioning thereof, which overcome at least these shortcomings of the prior art.

Figure 1:
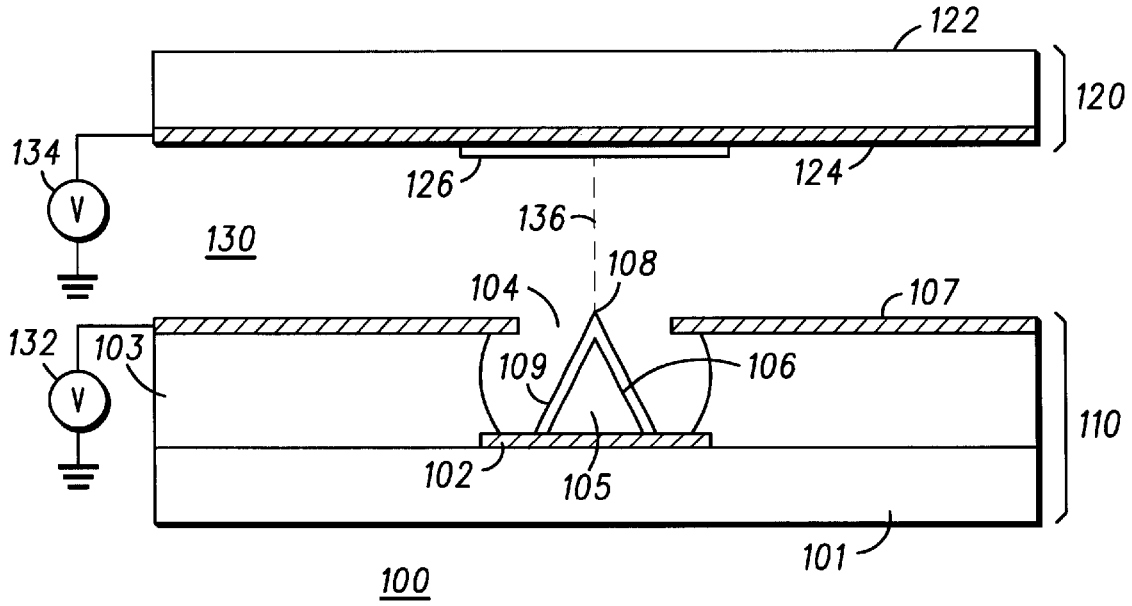
FIG. 1 is a cross-sectional view of a preferred embodiment of a field emission device, in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENT

The invention is for a field emission device in which each electron emitter structure has a deuteride layer. The deuteride layer is a passivating layer, which prevents at least the oxidation of the surface of the electron emitter structure. Furthermore, the deuterium of the deuteride layer is much more difficult to remove during the operation of the device, as contrasted with the removal of hydrogen from a hydride layer of prior art electron emitter structures. Thus, the field emission device of the invention has a greater lifetime than prior art field emission devices, which have hydride passivating layers.

The method of the invention for conditioning a field emission device includes the step of causing deuterium to react with a surface of an emitter structure. This step can include the step of causing a deuterium plasma to react with the surface of the emitter structure, prior to sealing of the package. Alternatively, it can include the step of providing deuterium gas within the field emission device at the time of sealing of the package. Because the deuteride layer formed by the method of the invention is difficult to remove, the method of the invention can obviate the need to provide additional deuterium subsequent to sealing of the package in order to achieve a favorable device lifetime.

The field emission devices described herein are directed to field emission display devices having triode configurations and employing Spindt tip emitter structures. However, the scope of the invention is not intended to be limited to display devices, to devices having a triode configuration, or to devices having Spindt tip emitter structures.

Rather, the invention can be embodied by other types of field emission devices, such as microwave power amplifier tubes, ion sources, matrix-addressable sources of electrons for electron-lithography, and the like. Also, the invention can be embodied by a field emission device having a diode configuration or a configuration having greater than three electrodes. In general, the invention is embodied by a vacuum device that employs field emission emitter structures, such as Spindt tips, edge emitters, wedge emitters, surface conduction emitters, and the like, which are made from a material that can be conditioned and passivated using deuterium free-radicals. The method of the invention for conditioning a field emission device can be performed on any of these alternative embodiments.

FIG. 1 is a cross-sectional view of a preferred embodiment of a field emission device (FED) 100, in accordance with the invention. As illustrated in FIG. 1, FED 100 includes a cathode plate 110 and an anode plate 120. Cathode plate 110 includes a substrate 101, which can be made from glass, silicon, and the like. A cathode 102 is disposed upon substrate 101. Cathode 102 is connected to a first voltage source (not shown). A dielectric layer 103 is disposed upon cathode 102, and further defines an emitter well 104.

An electron emitter structure 105 is disposed within emitter well 104. Electron emitter structure 105 includes an electron emitter 106. In the embodiment of FIG. 1, electron emitter 106 is a Spindt tip emitter, which is made from molybdenum.

In accordance with the invention, electron emitter structure 105 further has a deuteride layer 108. In the preferred embodiment of FIG. 1, deuteride layer 108 is disposed on electron emitter 106 and defines a surface 109 of electron emitter structure 105.

Preferably, deuteride layer 108 is made from a deuteride of the metal from which electron emitter 106 is made. Thus, in the preferred embodiment of FIG. 1, deuteride layer 108 is a layer of molybdenum deuteride.

Cathode plate 110 further includes a gate extraction electrode 107, which is disposed on dielectric layer 103 and is connected to a second voltage source 132. Application of selected potentials to cathode 102 and gate extraction electrode 107 can cause electron emitter structure 105 to emit an emission current 136.

Anode plate 120 is disposed to receive emission current 136. In the preferred embodiment of FIG. 1, anode plate 120 is spaced apart from cathode plate 110 to define an interspace region 130. Anode plate 120 includes a transparent substrate 122 made from a solid, transparent material, such as a glass. An anode 124 is disposed on transparent substrate 122 and is preferably made from a transparent, conductive material, such as indium tin oxide. Anode 124 is connected to a third voltage source 134.

A phosphor 126 is disposed upon anode 124. Phosphor 126 is cathodoluminescent and emits light upon activation by electrons from emission current 136. Methods for fabricating anode plates for matrix-addressable FED's are known to one of ordinary skill in the art. During the operation of FED 100, a potential is applied to anode 124 for attracting emission current 136 toward phosphor 126.

Figure 2:
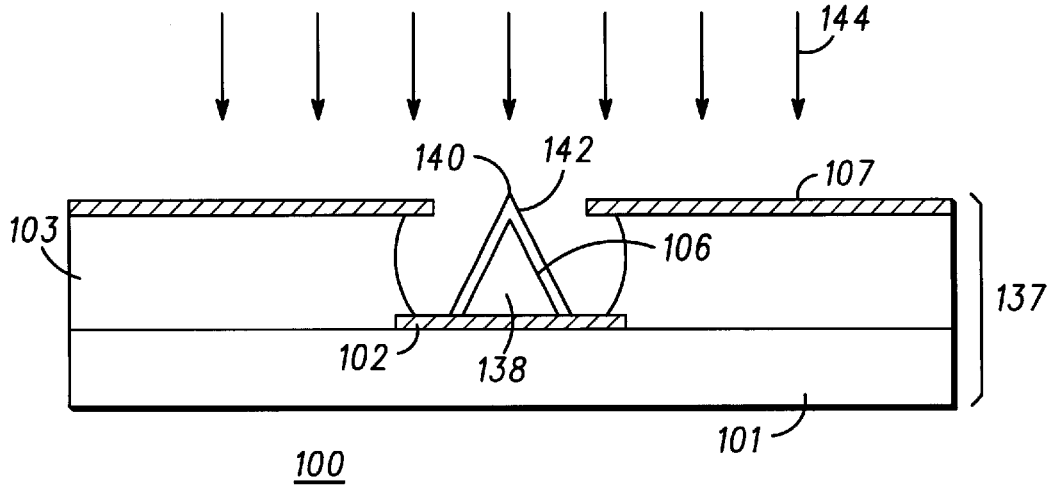
FIG. 2 is a cross-sectional view of a contaminated cathode structure upon which are performed steps in accordance with the method of the invention.

FIG. 2 is a cross-sectional view of a contaminated cathode structure 137 upon which are performed steps, in accordance with the method of the invention. Methods for fabricating cathode structures for matrix-addressable FED's are known to one of ordinary skill in the art.

After the cathode structure is fabricated, surfaces of the electron-emissive structures typically become contaminated by, for example, oxidation upon exposure to air. In general, the method of the invention is useful for conditioning an electron-emissive structure made from a field-emissive material that can be cleaned/passivated using free radicals of deuterium. Exemplary field-emissive materials include molybdenum, niobium, hafnium, tungsten, iridium, silicon, diamond-like carbon, and the like.

In the example of FIG. 2, contamination results in the formation of an emitter structure 138. Emitter structure 138 has a metal oxide layer 140, which is disposed upon electron emitter 106.

In general, the method of the invention for conditioning a FED includes the step of causing deuterium to react with a surface of an emitter structure. In the example of FIG. 2, this step includes the steps of providing a deuterium plasma or gas, which is represented by arrows 144 in FIG. 2, and causing the deuterium plasma or gas to react with a surface 142 of emitter structure 138. These steps are preferably performed prior to the evacuation and hermetic sealing of the FED.

In the example of FIG. 2, the deuterium reacts with metal oxide layer 140 of emitter structure 138, so that the oxygen of metal oxide layer 140 is replaced with deuterium. Additionally or alternatively, chemical species other than oxygen, such as carbon and sulfur, can be replaced with deuterium. In this manner, surface 142 is passivated with deuterium.

As a further example of the method of the invention and referring once again to FIG. 1, FED 100 can be conditioned subsequent to the step of hermetically sealing the device components, which include contaminated cathode structure 137. This example includes the step of providing, at a time subsequent to or during the sealing step, deuterium gas within the field emission device. Preferably, the deuterium gas is provided within interspace region 130 of FED 100. For example, the sealing step can be performed in a chamber having the desired partial pressure of deuterium.

The partial pressure of deuterium is selected to provide a sufficient amount of deuterium to react at a convenient rate with contaminants at surfaces 142 of contaminated emitter structures 138. The removal of contaminants may or may not be complete, but it is sufficient to provide a useful device lifetime. This partial pressure can be experimentally determined. The partial pressure of deuterium at the time of sealing is preferably within a range of $10^{-8}$–$10^{-4}$ Torr.

Alternatively and in accordance with the method of the invention, the deuterium gas can be controllably introduced subsequent to sealing at a rate/frequency sufficient to remove surface contaminants and maintain clean electron emitter structures 105. This can be achieved by, for example, providing a source of deuterium gas within FED 100 or by providing a membrane through which deuterium gas can be selectively diffused from a source external to FED 100.

Subsequent to the step of providing deuterium gas within the field emission device, emitter structures 138 are activated to emit electrons. These electrons can be those that constitute emission current 136, which is used to create the display image. Alternatively, emitter structures 138 can be activated to emit electrons for the sole purpose of conditioning FED 100, while preventing the creation of a display image. The creation of a display image can be prevented by, for example, applying ground potential to anode 124 to prevent attraction of the electrons thereto. As these electrons travel within interspace region 130, they dissociate and ionize the deuterium molecules, thereby forming deuterium free radicals.

The deuterium free radicals, which include deuterium ions and energetic neutral deuterium atoms, react with surfaces 142 of emitter structures 138. In addition to displacing contaminant species, such as oxygen, sulfur, and carbon, some of the deuterium may react with surface contaminants, to form volatile deuterides, thereby further conditioning emitter structures 138. These volatile deuterides are then removed from interspace region 130 by gettering material (not shown) present within FED 100.

It is desired to be understood that the conditioning process of the method of the invention is not limited to the replacement and removal of contaminants by the formation of deuterides alone. Conditioning can also occur when deuteride free radicals catalyze surface chemical reactions, which produce volatile products that do not include deuterides and which effectively remove surface contaminants.

In summary, the invention is for a field emission device in which each electron emitter structure has a deuteride layer. The deuteride layer prevents the occurrence of contaminating reactions at the surface of the electron emitter structure. The deuteride layer is also difficult to remove during the operation of the device, thereby improving device lifetime over that of the prior art. The method of the invention for conditioning a field emission device includes the step of causing deuterium to react with a surface of an emitter structure and preferably results in the formation of the deuteride layer. The conditioning can also include reaction of the deuterium with the surface of the emitter structure in a manner that produces volatile deuterides and/or catalyzes reactions, which result in the removal of contaminants.

While we have shown and described specific embodiments of the present invention, further modifications and improvements will occur to those skilled in the art. For example, the deuteride layer of the invention can be an embedded layer, such that it does not define the surface of the electron emitter structure. This particular embodiment can be useful for preventing advancement of an oxide interface or for preventing oxygen diffusion. As a further example, the electron emitter, upon which the deuteride layer is disposed, can include more than one type of metal. As yet a further example, the method of the invention can include the steps of providing deuterium gas within a space of the device other than the interspace region, which is connected to the interspace region, and ionizing the deuterium gas prior to its entry into the interspace region. The ionization can be performed by electron-emissive structures that are not used to create the display image. We desire it to be understood, therefore, that this invention is not limited to the particular forms shown, and we intend in the appended claims to cover all modifications that do not depart from the spirit and scope of this invention.

What is claimed is:

1. A field emission device comprising:

an electron emitter structure having a deuterido layer;

a transparent substrate;

an anode disposed on the transparent substrate; and a phosphor disposed on the anode and disposed to receive an emission current from the electron emitter structure.

2. The field emission device as claimed in claim 1, wherein the deuteride layer defines a surface of the electron emitter structure.

3. The field emission device as claimed in claim 1, wherein the electron emitter is made from a metal, wherein the deuteride layer is disposed on the electron emitter, and wherein the deuteride layer comprises a deuteride of the metal of the electron emitter.

4. The field emission device as claimed in claim 3, wherein the electron emitter is made from molybdenum.

* * * * *